US005637019A

United States Patent [19]

Crane, Jr. et al.

[11] Patent Number: 5,637,019

[45] Date of Patent: Jun. 10, 1997

[54] ELECTRICAL INTERCONNECT SYSTEM HAVING INSULATIVE SHROUDS FOR PREVENTING MISMATING

[75] Inventors: Stanford W. Crane, Jr.; Maria M. Portuondo, both of Boca Raton, Fla.

[73] Assignee: The Panda Project, Boca Raton, Fla.

[21] Appl. No.: 339,705

[22] Filed: Nov. 14, 1994

[51] Int. Cl.[6] ..... H01R 13/631

[52] U.S. Cl. ..... 439/677; 439/374

[58] Field of Search ..... 439/374, 680, 439/677

[56] References Cited

U.S. PATENT DOCUMENTS 3,112,974 12/1963 Curtis et al. ..... 439/680

OTHER PUBLICATIONS

Amp Product Guide, 1941–1991, Amp Incorporated, Harrisburg, PA 17105, pp. 4, 40, 42, 43, 76A, 77A, 80A, 11L, 12L, 3102, 3129 (1991).

*Primary Examiner*—Gary F. Paumen

*Attorney, Agent, or Firm*—Morgan, Lewis and Bockius LLP

[57] ABSTRACT

An electrical interconnect system comprising a first electrical connector including a first plurality of electrically conductive contacts and a first insulator shroud surrounding the first plurality of contacts, the first shroud comprising a first side wall having upwardly and downwardly sloping portions and a second side wall having upwardly and downwardly sloping portions; and a second electrical connector including a second plurality of electrically conductive contacts and a second insulative shroud surrounding the second plurality of contacts, the second shroud comprising a third side wall having upwardly and downwardly sloping portions and a fourth side wall having upwardly and downwardly sloping portions, the first side wall being complementary with respect to the third wall, the second wall being complementary with respect to the fourth wall, and the sloping portions being configured such that, upon mating of the first and second electrical connectors, upper surfaces of the sloping portions of the first side wall contact upper surfaces of the sloping portions of the third side wall, and upper surfaces of the sloping portions of the second side wall contact upper surfaces of the sloping portions of the fourth side wall, to facilitate mating alignment between the connectors.

18 Claims, 16 Drawing Sheets

ELECTRICAL INTERCONNECT SYSTEM HAVING INSULATIVE SHROUDS FOR PREVENTING MISMATING

BACKGROUND OF THE INVENTION

1. Field of the Invention

The present invention relates to an insulator for housing an electrical connector and, more particularly, to an insulator housing for an electrical connector with the insulator housing having polarizing end sections and/or contoured side walls.

2. Description of the Related Art

A conventional electrical interconnect system 10 is depicted in FIG. 1. Electrical interconnect system 10 includes a first connector 11 having a shroud 12, and a second connector 13 having a shroud 14. Connector 11 includes a plurality of electrically conductive contacts surrounded by shroud 12, and connector 13 includes a plurality of electrically conductive contacts surrounded by shroud 14. The connectors are configured so that shroud 12 of first cennector 11 may be plugged into shroud 14 of second connector 13, thereby bringing the conductive contacts surrounded by shroud 12 of first connector 11 into conductive contact with the conductive contacts surrounded by shroud 14 of second connector 13.

Shroud 12 of first connector 11 has a smaller outer peripheral dimension than the inner peripheral dimension of shroud 14 of connector 13 so that shroud 12 will fit within shroud 14 when first connector 11 and second connector 13 are mated. Shrouds 12 and 14 are D-shaped for polarization.

The present invention is an improvement upon electrical interconnect systems of the type described above.

SUMMARY OF THE INVENTION

The principle advantage of the present invention is the provision of an arrangement which substantially obviates one or more of the limitations and disadvantages of conventional arrangements.

In this regard, an advantage results from the present invention providing an electrical interconnect system using polarized connectors so as to avoid mismating the connectors when arranged 180° relative to one another.

A further advantage is provided by the present invention in that each connector can be accurately aligned and held down over corresponding pads on a printed circuit board during surface mounting.

Another advantage of the present invention is the protection of the contact areas of electrically conductive contacts from damage resulting from mismating and from damage incurred during handling and shipping.

Yet another advantage of the present invention relates to the provision of alignment between electrical connectors as they slide together and mate.

To achieve these and other advantages, and in accordance with the purpose of the invention, as embodied and broadly described, the invention comprises an electrical interconnect system having a first electrical connector including a first plurality of electrically conductive contacts and a first insulator shroud surrounding the first plurality of contacts, the first shroud comprising a first side wall having upwardly and downwardly sloping portions and a second side wall having upwardly and downwardly sloping portions; and a second electrical connector having a second plurality of electrically conductive contacts and a second insulative shroud surrounding the second plurality of contacts, the second shroud comprising a third side wall having upwardly and downwardly sloping portions and a fourth side wall having upwardly and downwardly sloping portions, the first side wall being complementary with respect to the third wall, the second wall being complementary with respect to the fourth wall, and the sloping portions being configured such that, upon mating of the first and second electrical connectors, upper surfaces of the sloping portions of the first side wall contact upper surfaces of the sloping portions of the third side wall, and upper surfaces of the sloping portions of the second side wall contact upper surfaces of the sloping portions of the fourth side wall, to facilitate mating alignment between the connectors.

Additional features and advantages of the invention will be set forth in the description which follows, and in part will be apparent from the description, or may be learned by practice of the invention. The objectives and other advantages of the invention will be realized and attained by the arrangements particularly pointed out in the written description and claims hereof, as well as the appended drawings.

BRIEF DESCRIPTION OF THE DRAWINGS

The accompanying drawings, which are incorporated in and constitute a part of this specification, illustrate embodiments of the invention and, together with the description, serve to explain the advantages and principles of the invention.

In the drawings.

DETAILED DESCRIPTION OF THE PREFERRED EMBODIMENTS

Reference will now be made in detail to the present preferred embodiments of the invention, examples of which are illustrated in the accompanying drawings.

Figure 1:
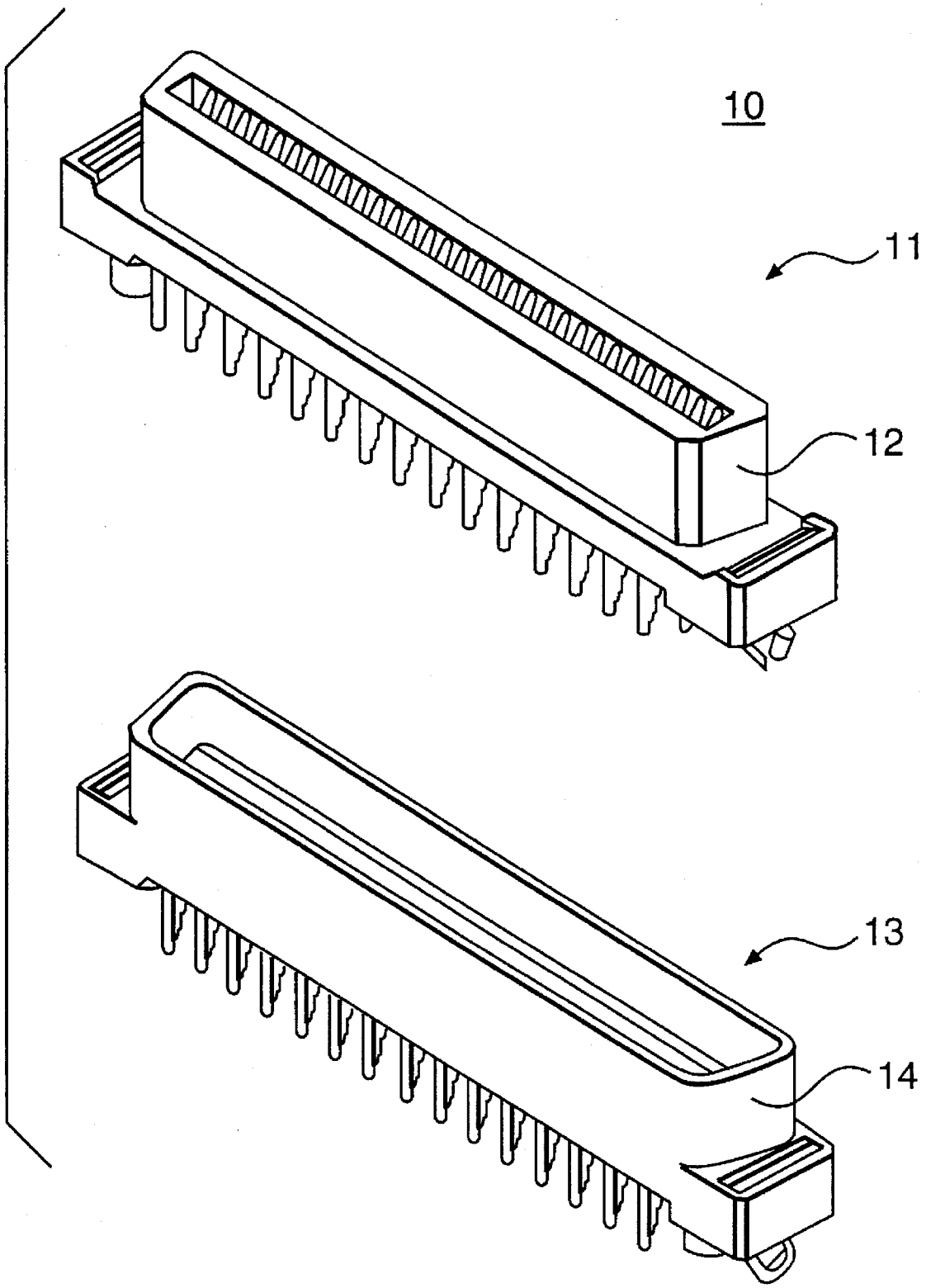
FIG. 1 (PRIOR ART)
FIG. 1 is a perspective view of a conventional electrical interconnect system.
Figure 2:
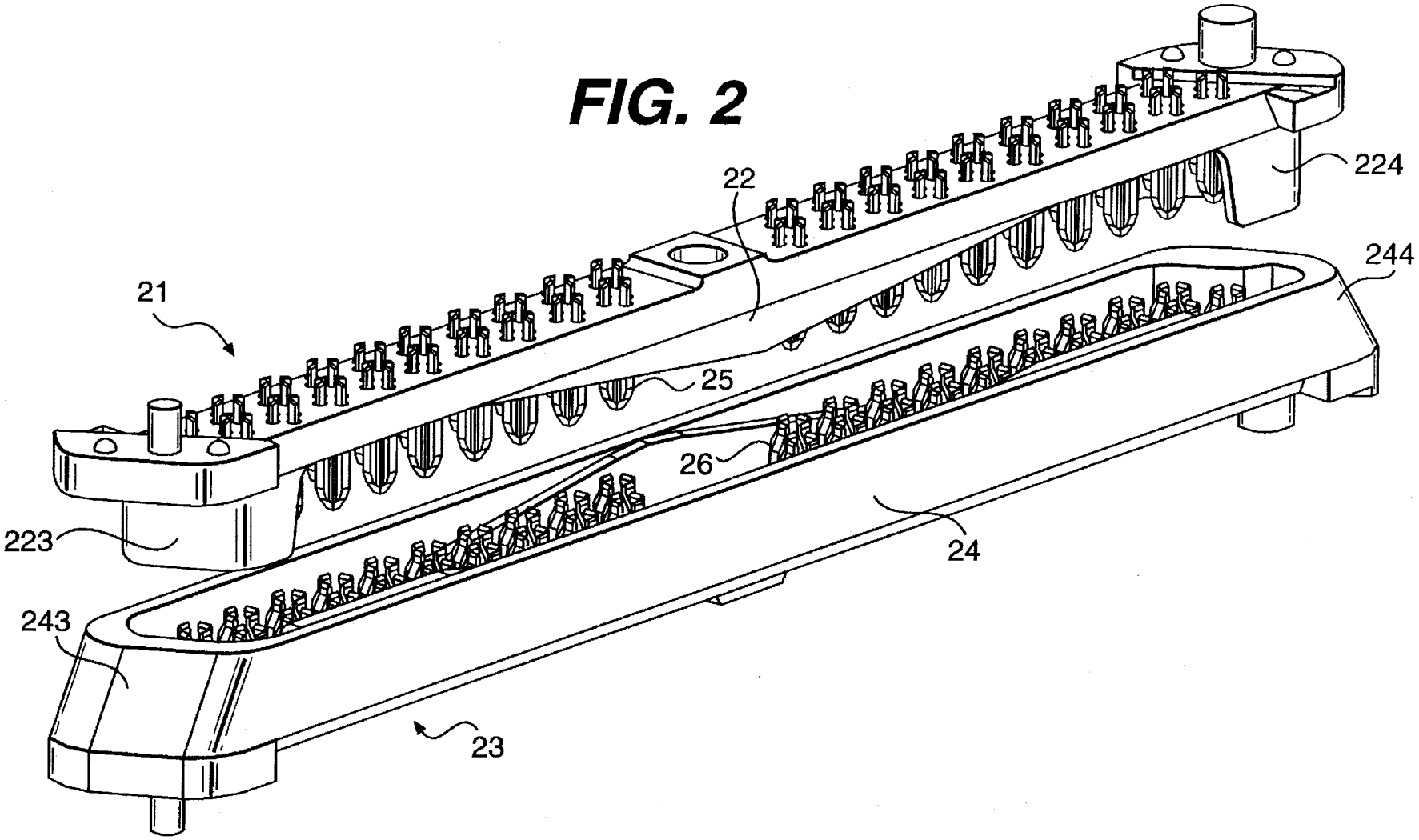
FIG. 2 is a perspective view of an electrical interconnect system in accordance with the present invention just prior to the mating of a first electrical connector with a second electrical connector.
Figure 3A:
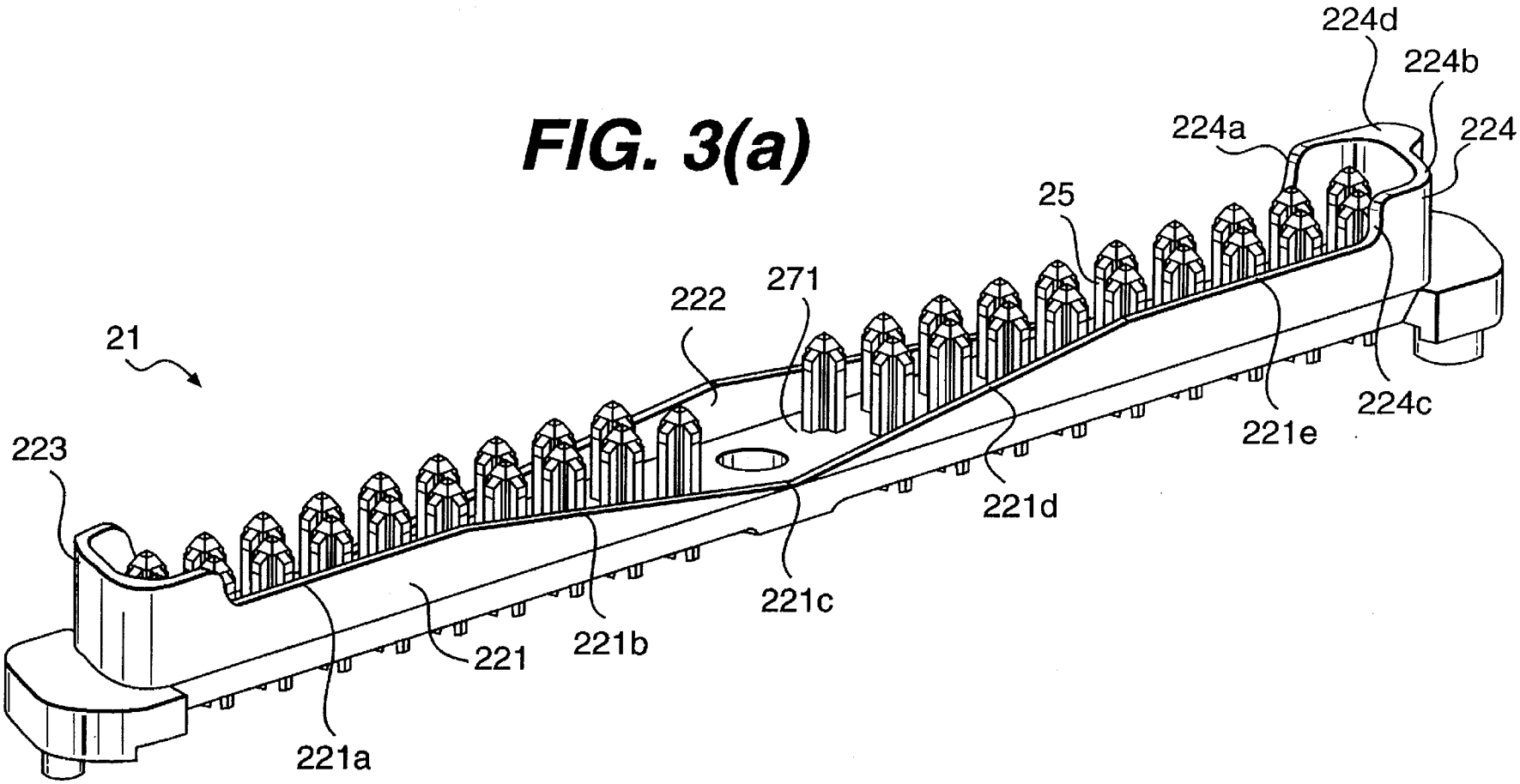
FIGS. 3(*a*), 3(*b*), 3(*c*), and 3(*d*) are different perspective views of the first electrical connector shown in FIG. 2.
Figure 3B:
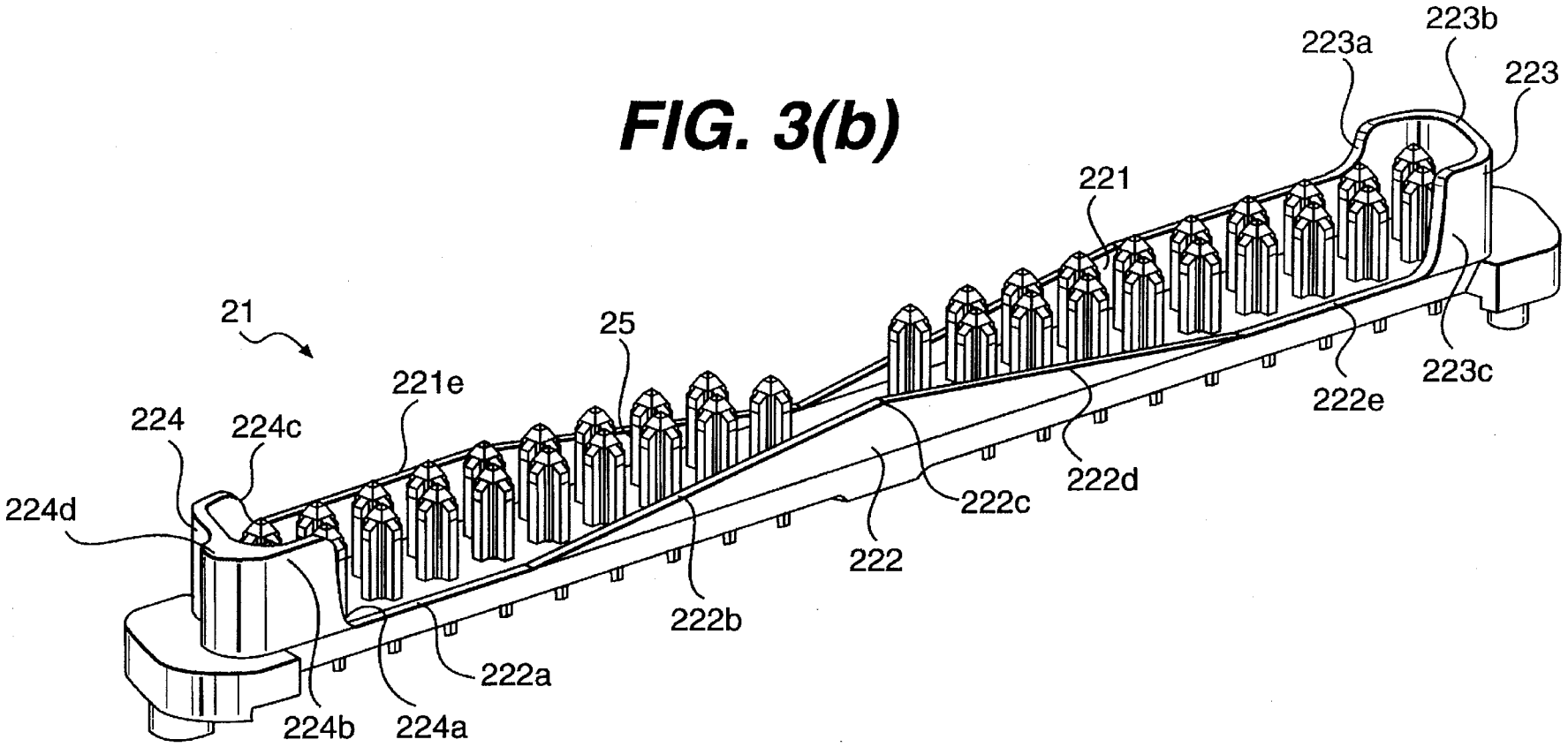
Figure 3C:
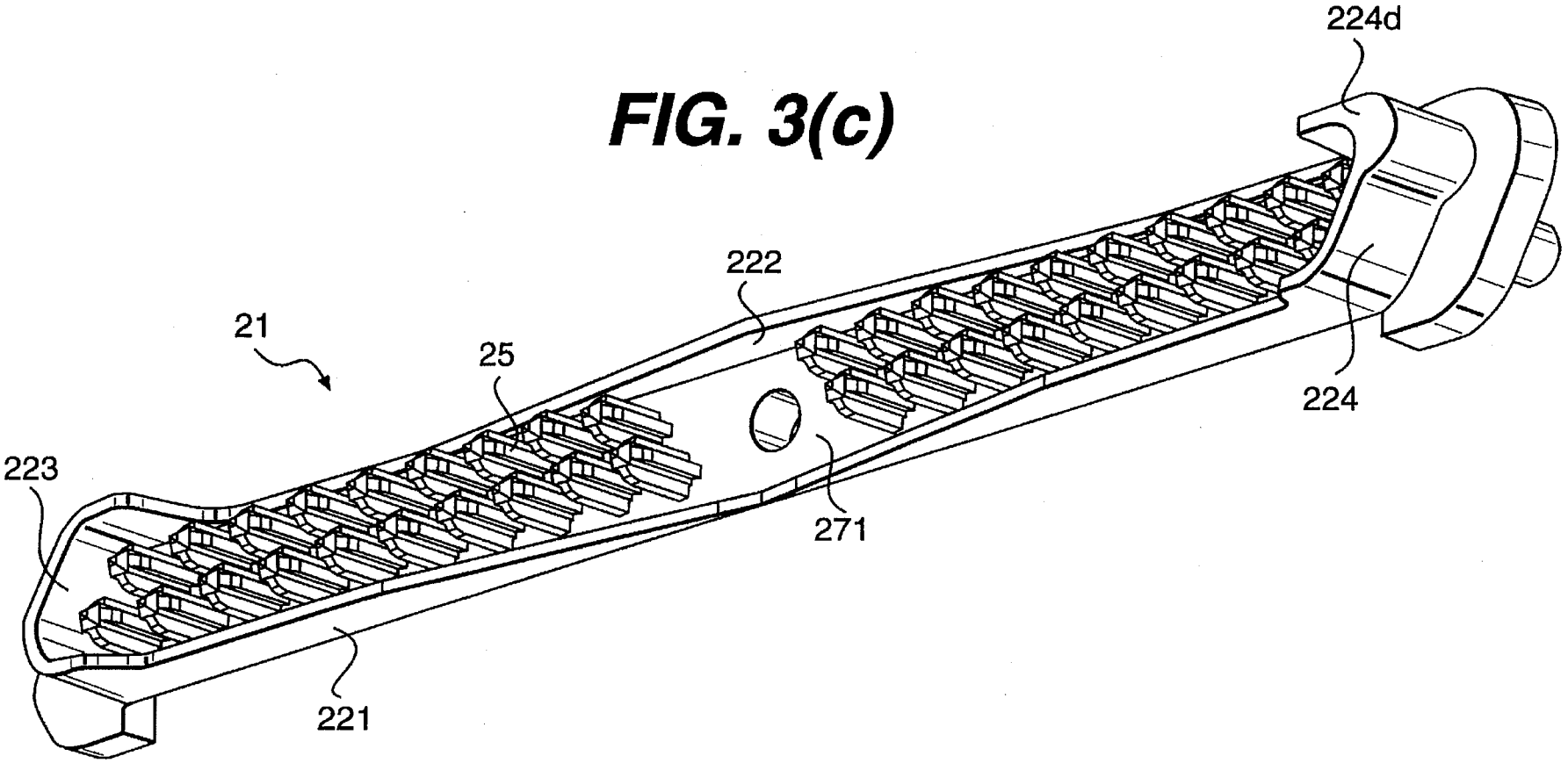
Figure 3D:
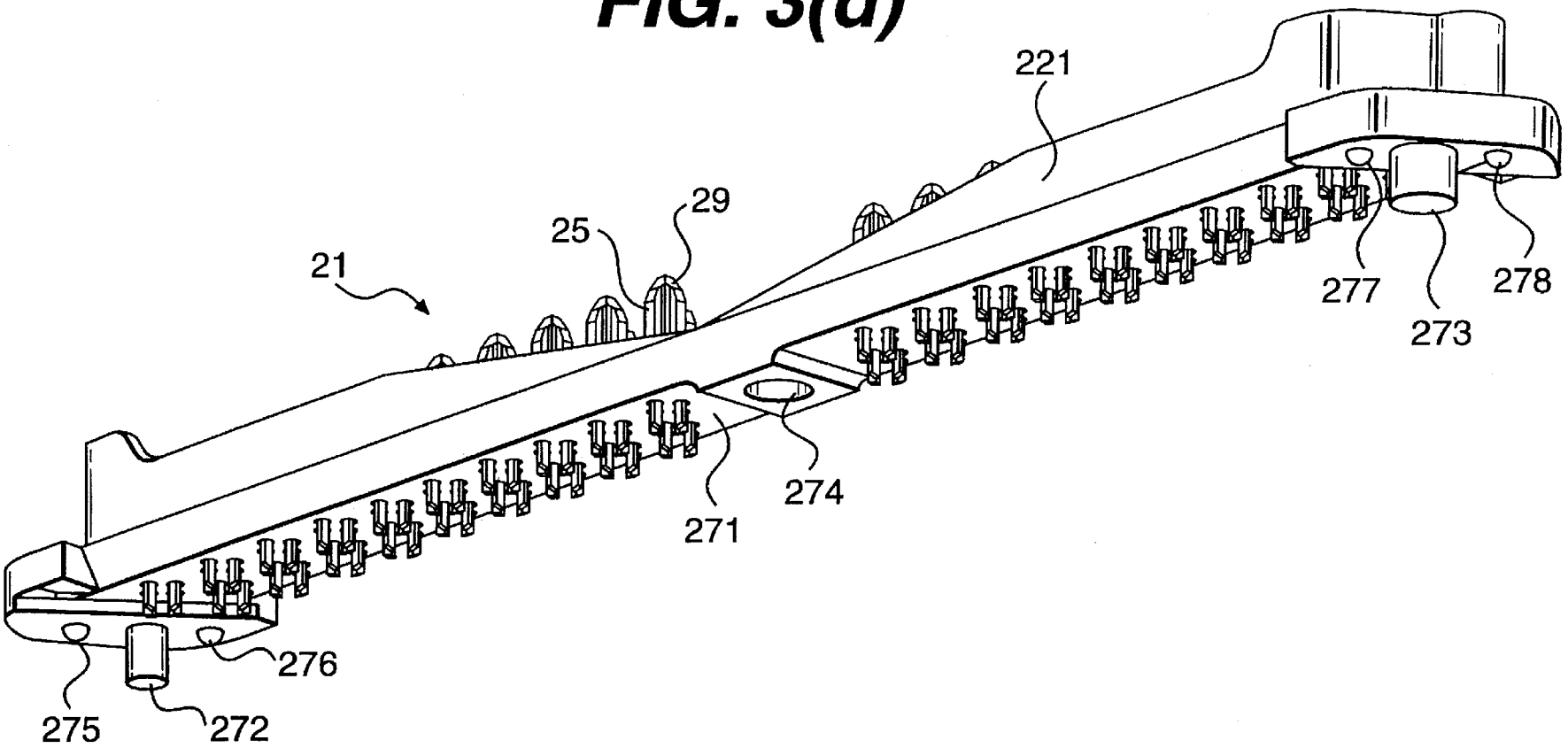
Figure 4A:
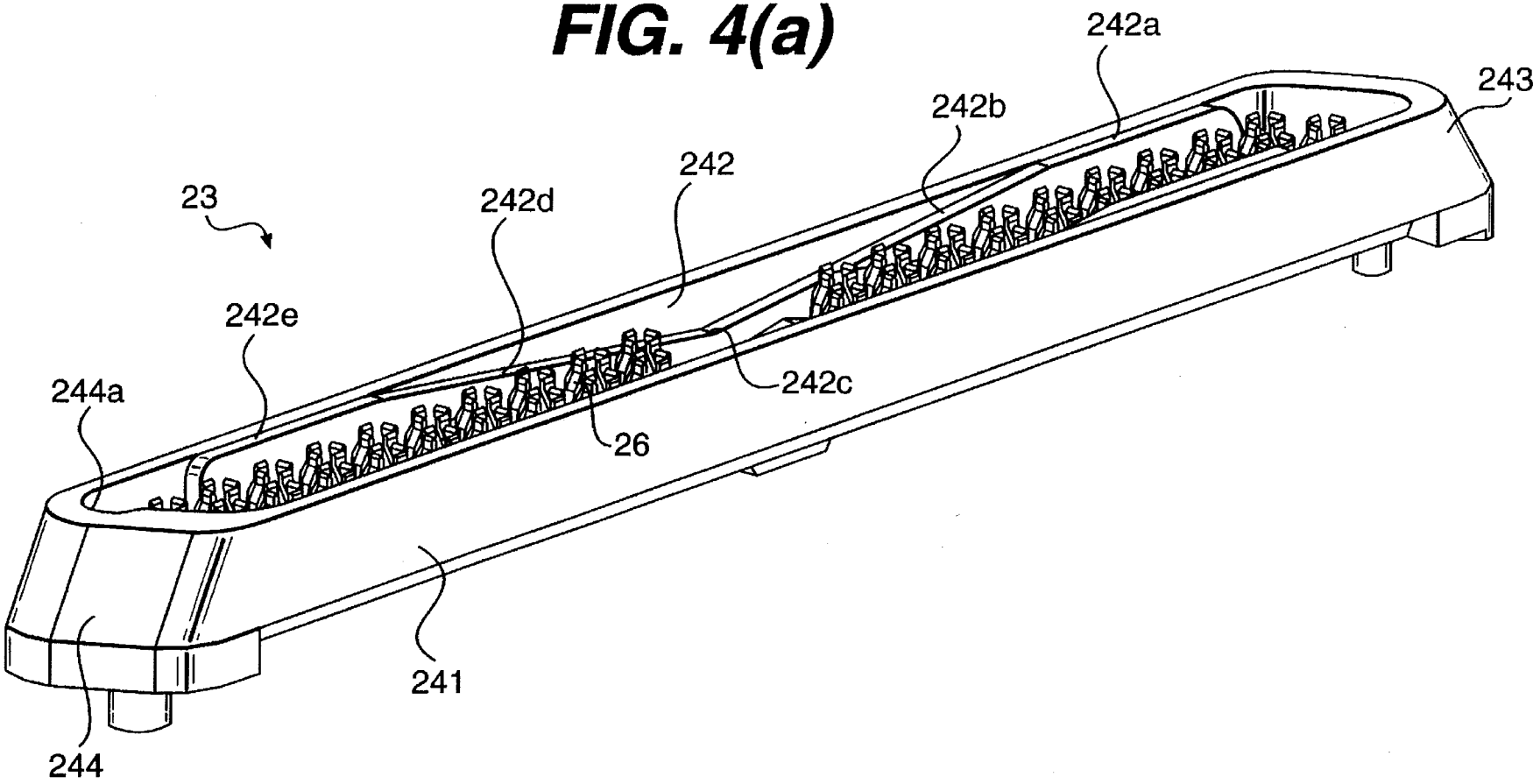
FIGS. 4(*a*), 4(*b*), 4(*c*), and 4(*d*) are different perspective views of the second electrical connector shown in FIG. 2, with FIG. 4(*d*) omitting the electrically conductive contacts of the second electrical connector.
Figure 4B:
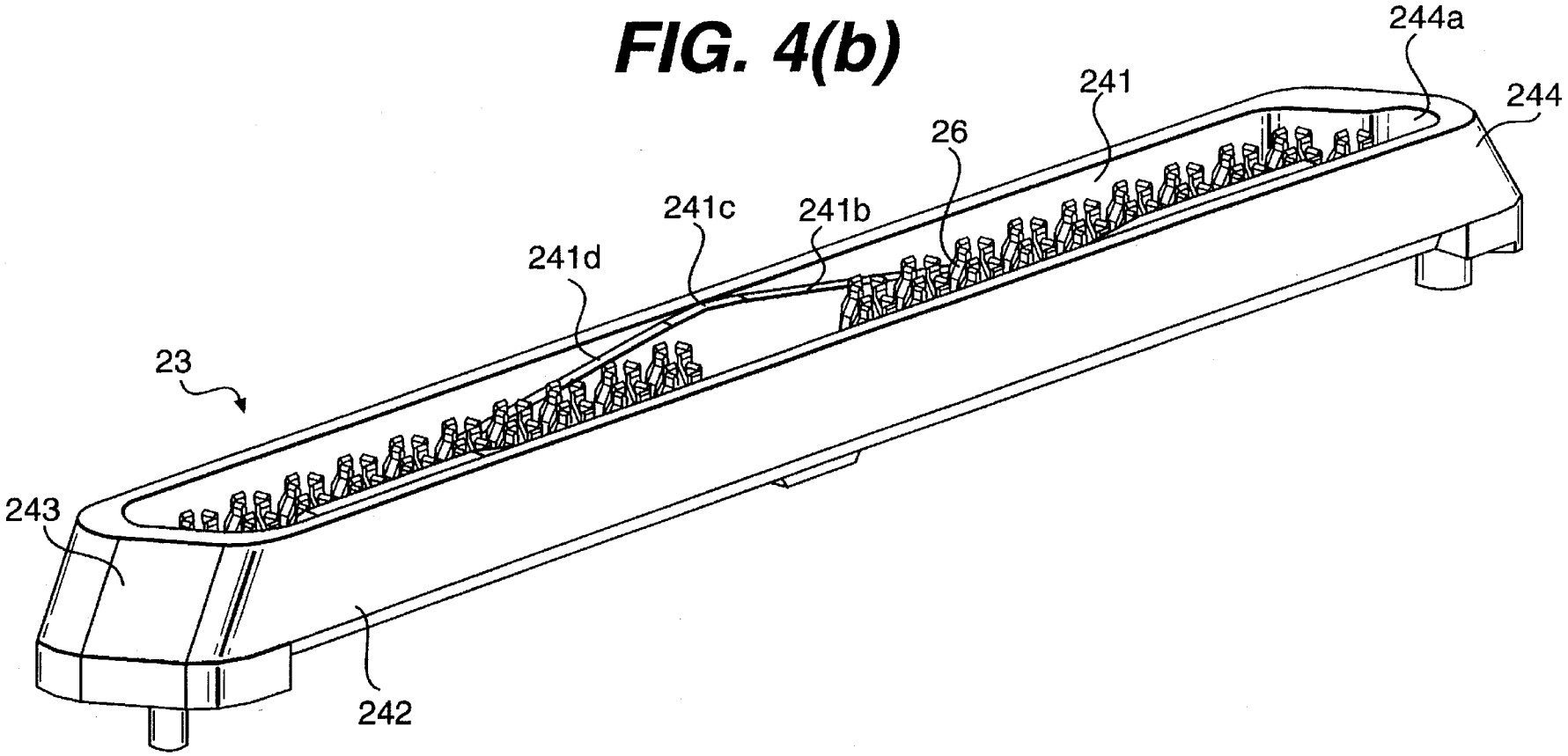
Figure 4C:
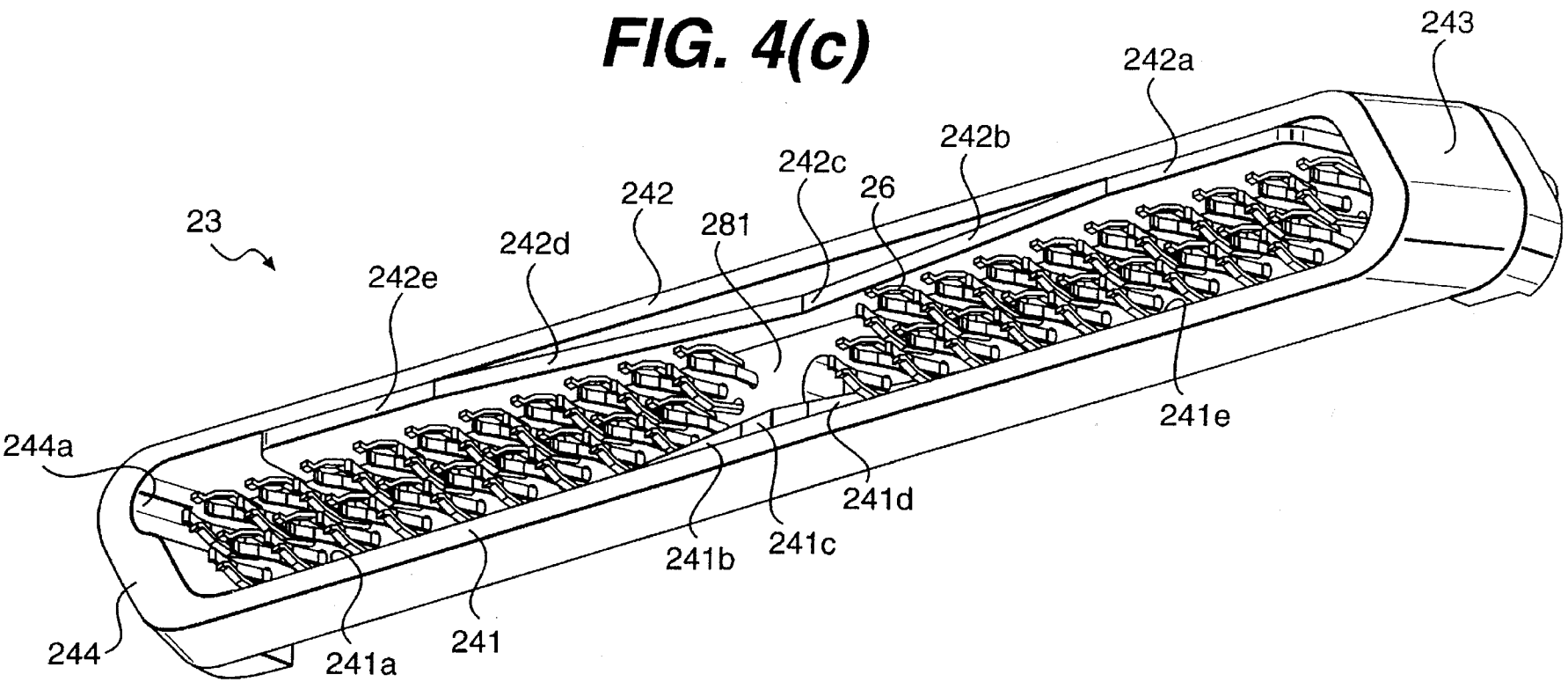
Figure 4D:
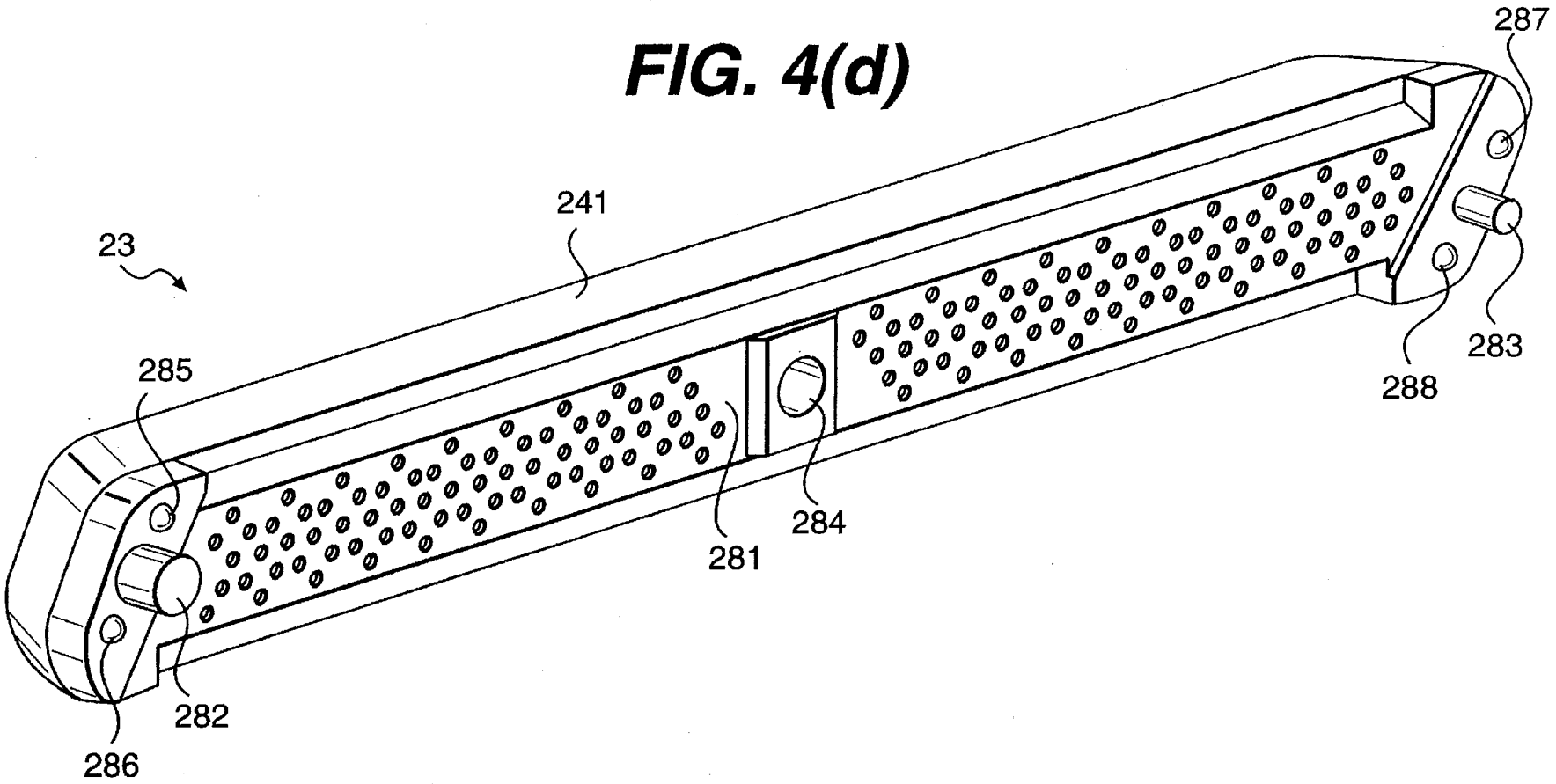

An exemplary embodiment of an electrical interconnect system in accordance with the present invention is shown in FIG. 2 and is designated generally by reference numeral 20. As embodied herein and referring to FIG. 2, electrical interconnect system 20 includes a first electrical connector 21 comprising a shroud 22, and a second electrical connector 23 comprising a shroud 24. Shrouds 22 and 24 are made up of walls surrounding electrically conductive contacts 25 of first connector 21 and surrounding electrically conductive contacts 26 of second connector 23, respectively. Connectors 21 and 23 are configured so that first connector 21 may be plugged into second connector 23, thereby bringing electrically conductive contacts 25 of first connector 21 into conductive contact with electrically conductive contacts 26 of second connector 23.

FIGS. 3(*a*), 3(*b*), 3(*c*), and 3(*d*), collectively referred to herein as FIG. 3, are different views of first electrical connector 21 shown in FIG. 2. As can be seen from FIG. 3, shroud 22 of first connector 21 is made up of side walls 221,222, and end sections 223, 224, which surround electrically conductive contacts 25 of first connector 21. Electrically conductive contacts 25 of first connector 21 are configured for electrical contact with electrically conductive contacts 26 of second connector 23 (FIGS. 2 and 4) at the time of mating between first connector 21 and second connector 23.

Referring back to FIG. 3, side wall 221 comprises a section 221*a* having its upper edge parallel or substantially parallel with respect to the upper surface of floor 271 through which electrically conductive contacts 25 protrude; a section 221*b* having a gradually sloping upper edge; a section 221*c* having its upper edge parallel or substantially parallel with respect to the upper surface of floor 271 or, alternatively, at the same level as that surface (i.e., flush with respect to the upper surface of floor 271) or, alternatively, section 221*c* could be eliminated altogether so that the upper edges of sections 221*b* and 221*d* slope down into direct contact with one another; a section 221*d* having a gradually sloping upper edge; and a section 221*e* having its upper edge parallel or substantially parallel with respect to the upper surface of floor 271.

In FIG. 3, side wall 222 comprises a section 222*a* having its upper edge parallel or substantially parallel with respect to the upper surface of floor 271 or, alternatively, at the same level as that surface (i.e., flush with respect to the upper surface of floor 271); a section 222*b* having a gradually sloping upper edge; a section 222*c* having its upper edge parallel or substantially parallel with respect to the upper surface of floor 271 or, alternatively, section 222*c* could be eliminated altogether so that the upper edges of sections 222*b* and 222*d* peak into direct contact with one another; a section 222*d* having a gradually sloping upper edge; and a section 222*e* having its upper edge parallel or substantially parallel with respect to the upper surface of floor 271 or, alternatively, at the same level as that surface (i.e., flush with respect to the upper surface of floor 271).

End section 223 comprises a section 223*a* either gradually sloping or perpendicular or substantially perpendicular with respect to the upper surface of floor 271 and connecting section 221*a* of side wall 221 to section 223*b* of end section 223; a section 223*b* having its upper edge parallel or substantially parallel with respect to the upper surface of floor 271; and a section 223*c* either gradually sloping or perpendicular or substantially perpendicular with respect to the upper surface of floor 271 and connecting section 222*e* of side wall 222 to section 223*b* of end section 223.

End section 224 comprises a section 224*a* either gradually sloping or perpendicular or substantially perpendicular with respect to the upper surface of floor 271 and connecting section 222*a* of side wall 222 to section 224*b* of end section 224; a section 224*b* having its upper edge parallel or substantially parallel with respect to the upper surface of floor 271; and a section 224*c* either gradually sloping or perpendicular or substantially perpendicular with respect to the upper surface of floor 271 and connecting section 221*e* of side wall 221 to section 224*b* of end section 224.

A bump or protruding element 224*d* extends outwardly from section 224*b*. Protruding element 224*d* gives the outer periphery of end section 224 a different configuration than that of the outer periphery of end section 223. Due to the provision of protruding element 224*d*, the overall shape of the outer periphery of shroud 22 is generally that of a parallelogram having rounded corners with a protruding element extending out of only one of the end sections of the shroud.

As shown in FIG. 3, in addition to shroud 22 and electrically conductive contacts 25, first connector 21 also includes a contact support and hold-down structure comprising floor 271 through which electrically conductive contacts 25 protrude; guide posts 272, 273; a fastener hole 274; and standoffs 275, 276, 277, and 278. Floor 271 supports and maintains the position of electrically conductive contacts 25, and guide posts 272, 273, fastener hole 274, and standoffs 275, 276, 277, and 278, help secure and align first connector 21 on a printed circuit board (not shown) via, for example, a surface mounting process.

More particularly, guide posts 272, 273, located at either end of first connector 21, fit into holes on the printed circuit board and facilitate registration of electrically conductive contacts 25 over corresponding conductive pads on the printed circuit board. Guide posts 272, 273 may have different diameters to prevent first connector 21 from being mounted backwards on the printed circuit board. Alternatively, guide posts 272, 273 could each be replaced by a fastener hole configured to receive a screw or like fastener to secure first connector 21 to the circuit board.

Fastener hole 274, preferably located at a central location of first connector 21, is configured to receive a screw or like fastener to secure first connector 21 to the printed circuit board or, alternatively, the location of fastener hole 274 could be the location for an integral fastener, such as a pre-fit fastener. Standoffs 275, 276, and 277, 278, located near guide posts 272 and 273, respectively, serve to elevate first connector 21 from the printed circuit board and allow for cleaning and uniform heating during the surface mounting process.

As can be seen from FIG. 3, electrically conductive contacts 25 protrude through both the upper and lower surfaces of floor 271. The portions of electrically conductive contacts 25 extending out of the lower surface of floor 271, as discussed above, are configured to be surface mounted to pads on the printed circuit board (not shown) upon which first connector 21 being mounted. The portions of electrically conductive contacts 25 extending up through the upper surface of floor 271 are configured for mating with corresponding electrically conductive contacts 26 of second connector 23.

Electrically conductive contacts 25 of first connector 21, and also electrically conductive contacts 26 of second connector 23, are preferably arranged in groups (four contacts per group, for example), with the groups of contacts from first connector 21 being called projection-type electrical interconnect components, the groups of contacts from second connector 23 being called receiving-type electrical interconnect components, and each projection-type electrical interconnect component of first connector 21 being configured for receipt within a corresponding receiving-type electrical interconnect component from second connector 23. Alternatively, receiving-type electrical interconnect components could be formed on first connector 21 instead of projection-type electrical interconnect components (of course, in this scenario, first connector 21 would not include any buttresses), and projection-type electrical interconnect components could be formed on second connector 23 instead of receiving-type electrical interconnect components, with each receiving-type electrical interconnect component of first connector 21 being configured to receive a corresponding projection-type electrical interconnect component from second conductor 23.

In FIGS. 2 and 3, each projection-type electrical interconnect component of first connector 21 is made up of four electrically conductive contacts 25 surrounding an insulative buttress 29. The use of buttresses is optional in connection with the present invention and, therefore, each projection-type electrical interconnect component could be without a buttress. Also, in FIGS. 2 and 4, each receiving-type electrical interconnect component of second connector 23 is made up of four electrically conductive contacts 26 configured to receive a corresponding one of electrically conductive contacts 25 from first connector 21. At the time of mating between first and second connectors 21 and 23, each projection-type electrical interconnect component from first connector 21 is inserted within a corresponding receiving-type electrical interconnect component from second connector 23 (i.e., inserted between the individual contacts 26 of that receiving-type electrical interconnect component), thereby bringing the individual contacts 25 of first connector 21 into contact with the individual contacts 26 of second connector 23.

Additional examples of the various types of electrical interconnect components that are envisioned for use in connection with the present invention are disclosed in copending U.S. patent application Ser. No. 07/983,083 to Stanford W. Crane, Jr., filed Dec. 1, 1992, and entitled "HIGH-DENSITY ELECTRICAL INTERCONNECT SYSTEM," and in copending U.S. patent application Ser. No. 08/209,219 to Stanford W. Crane, Jr., filed Mar. 11, 1994, and also entitled "HIGH-DENSITY ELECTRICAL INTERCONNECT SYSTEM." Both of the aforementioned patent applications are expressly incorporated herein by reference. Although the use of contacts arranged in groups of projection-type and receiving-type electrical interconnect components and configured in accordance with the aforementioned patent applications is preferred, it should be noted that the present invention is also suitable for use in connection with most, if not all, types of electrically conductive contacts known to the inventors.

Just as FIG. 3 provides additional details on first connector 21, FIGS. 4(*a*), 4(*b*), 4(*c*), and 4(*d*), collectively referred to herein as FIG. 4, provide additional details on second connector 23. As discussed above, first connector 21 and second connector 23 are configured so that, when such connectors are mated, electrical signals can travel between electrically conductive contacts 25 of first connector 21 and electrically conductive contacts 26 of second connector 23.

With reference to FIG. 4, the shroud of second connector 23 comprises side walls 241, 242, and end sections 243, 244, which surround electrically conductive contacts 26 of second connector 23. Electrically conductive contacts 26 of second connector 23 are configured for electrical contact with electrically conductive contacts 25 of first connector 21 (FIGS. 2 and 3) at the time of mating between first connector 21 and second connector 23.

Referring back to FIG. 4, the inner periphery of side wall 241 of second connector 23 and the inner periphery of side wall 242 of second connector 23 are contoured. The contour of the inner periphery of side wall 241 of second connector 23 is the complement of the contour or shape of side wall 221 of first connector 21 (shown in FIG. 3), and the contour of the inner periphery of side wall 242 of second connector 2 is the complement of the contour or shape of side wall 222 of first connector 21 (shown in FIG. 3). When first connector 21 and second connector 23 are mated, therefore, the upper edges of side wall 221 of first connector 21 abut the upper edges of the contour of the inner periphery of side wall 241 of second connector 23, and the upper edges of side wall 222 of first connector 21 abut the upper edges of the contour of the inner periphery of side wall 242 of second connector 23.

The contour of the inner periphery of side wall 241 comprises a section 241*a* having its upper edge parallel or substantially parallel with respect to the upper surface of floor 281 through which electrically conductive contacts 26 protrude or, alternatively, at the same level as that surface (i.e., flush with respect to the upper surface of floor 281); a section 241*b* having a gradually sloping upper edge; a section 241*c* having its upper edge parallel or substantially parallel with respect to the upper surface of floor 281 (e.g., flush with respect to the upper edge of the outer periphery of side wall 241) or, alternatively, section 241*c* could be eliminated altogether so that the upper edges of sections 241*b* and 241*d* peak into direct contact with one another; a section 241*d* having a gradually sloping upper edge; and a section 241*e* having its upper edge parallel or substantially parallel with respect to the upper surface of floor 281 or, alternatively, at the same level as that surface (i.e., flush with respect to the upper surface of floor 281).

The contour of the inner periphery of side wall 242 comprises a section 242*a* having its upper edge parallel or substantially parallel with respect to the upper surface of floor 281 (e.g., flush with respect to the upper edge of the outer periphery of side wall 242); a section 242*b* having a gradually sloping upper edge; a section 242*c* having its upper edge parallel or substantially parallel with respect to the upper surface of floor 281 or, alternatively, at the same level as that surface (i.e., flush with respect to the upper surface of floor 281) or, alternatively, section 242*c* could be eliminated altogether so that the upper edges of sections 242*b* and 242*d* slope down into direct contact with one another; a section 242*d* having a gradually sloping upper edge; and a section 242*e* having its upper edge parallel or substantially parallel with respect to the upper surface of floor 281 (e.g., flush with respect to the upper edge of the outer periphery of side wall 242).

End section 243 functions to connect side wall 241 and side wall 242. The upper edge of the end section 243 is preferably flush with respect to the upper edge of the outer periphery of side wall 241 and also preferably flush with respect to the upper edge of the outer periphery of side wall 242. Also, preferably, the inner periphery of end section 243 is not contoured. Instead, the inner periphery of end section 243 preferably corresponds to a substantially flat, vertical surface complementing the outer periphery of end section 223 of first connector 21.

End section 244 functions to connect side wall 241 and side wall 242 at an end of second connector 23 opposite the end at which end section 243 is located. The upper edge of end section 244 is preferably flush with respect to the upper edge of the outer periphery of side wall 241 and also preferably flush with respect to the upper edge of the outer periphery of side wall 242. Also, preferably, the inner periphery of end section 244 is contoured to include an indented portion 244*a* complementing protruding element 224*d* of first connector 21. Due to the provision of indented portion 244*a*, the overall shape of the inner periphery of shroud 24 is generally that of a parallelogram having rounded corners with an indented portion provided at only one of the end sections of the shroud.

As shown in FIG. 4, in addition to shroud 24 and electrically conductive contacts 26, second connector 23 also includes a contact support and hold-down structure comprising floor 281 through which electrically conductive contacts 26 protrude; guide posts 282, 283; a fastener hole 284; and standoffs 285, 286, 287, and 288. Floor 281 supports and maintains the position of electrically conductive contacts 26, and guide posts 282, 283, fastener hole 284, and standoffs 285, 286, 287, and 288, help secure second connector 23 on a printed circuit board (not shown) via, for example, a surface mounting process. As with previously-discussed guide posts 272, 273, guide posts 282, 283 could each be replaced by a fastener hole configured to receive a screw or like fastener to secure second connector 23 to the circuit board. Also, as with previously-discussed fastener hole 274, the location of fastener hole 284 could be the location of an integral fastener, such as a press-fit fastener.

Components 281 through 288 of second connector 23 are essentially identical to components 271 through 278 of first connector 21, respectively, except that floor 281 supports and maintains the position of electrically conductive contacts 26 rather than electrically conductive contacts 25 which, instead, are supported by floor surface 271, and components 282 through 288 mount second conductor 23 to a circuit board different than the one to which first connector 21 is mounted by components 272 through 278. Further description of components 281 through 288 is not considered necessary in view of the detailed description of similar components 271 through 278 set forth above.

As can be seen from FIG. 4, electrically conductive contacts 26 protrude through both the upper and lower surfaces of floor 281. The portions of electrically conductive contacts 26 extending out of the lower surface of floor 281, as discussed above, are configured to be surface mounted to pads on the printed circuit board to which second connector 23 is being mounted. The portions of electrically conductive contacts 26 extending up through the upper surface of floor 281 are configured for mating with corresponding electrically conductive contacts 25 of first connector 21.

Figure 5:
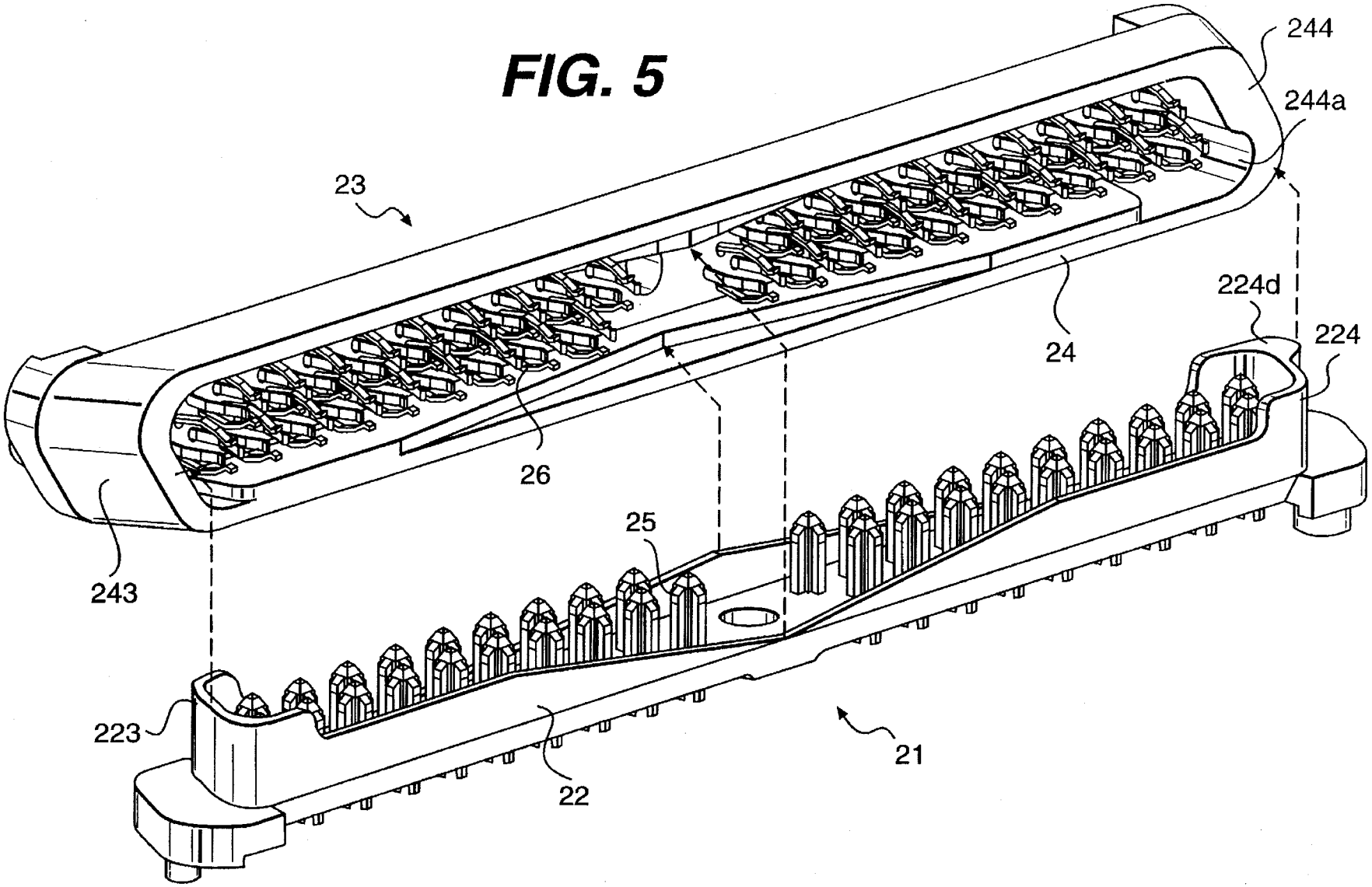
FIG. 5 is another perspective view of the electrical interconnect system of FIG. 2 just prior to the mating of the first electrical connector with the second electrical connector and having arrows matching complementary portions of the first and second electrical connectors.
Figure 6:
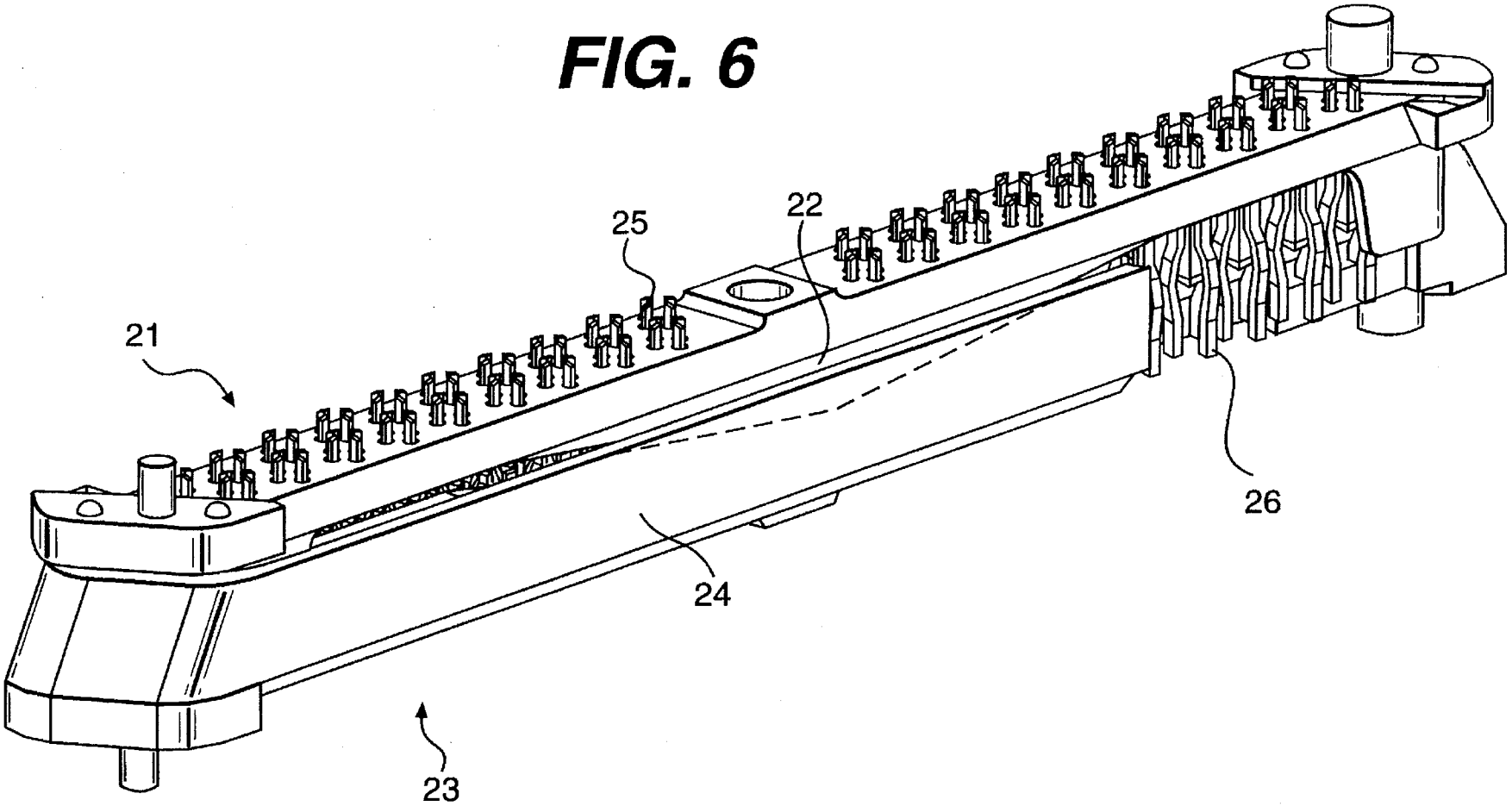
FIG. 6 is a perspective view of the electrical interconnect system shown in FIGS. 2 and 5 during the mating of the first electrical connector with the second electrical connector.
Figure 7A:
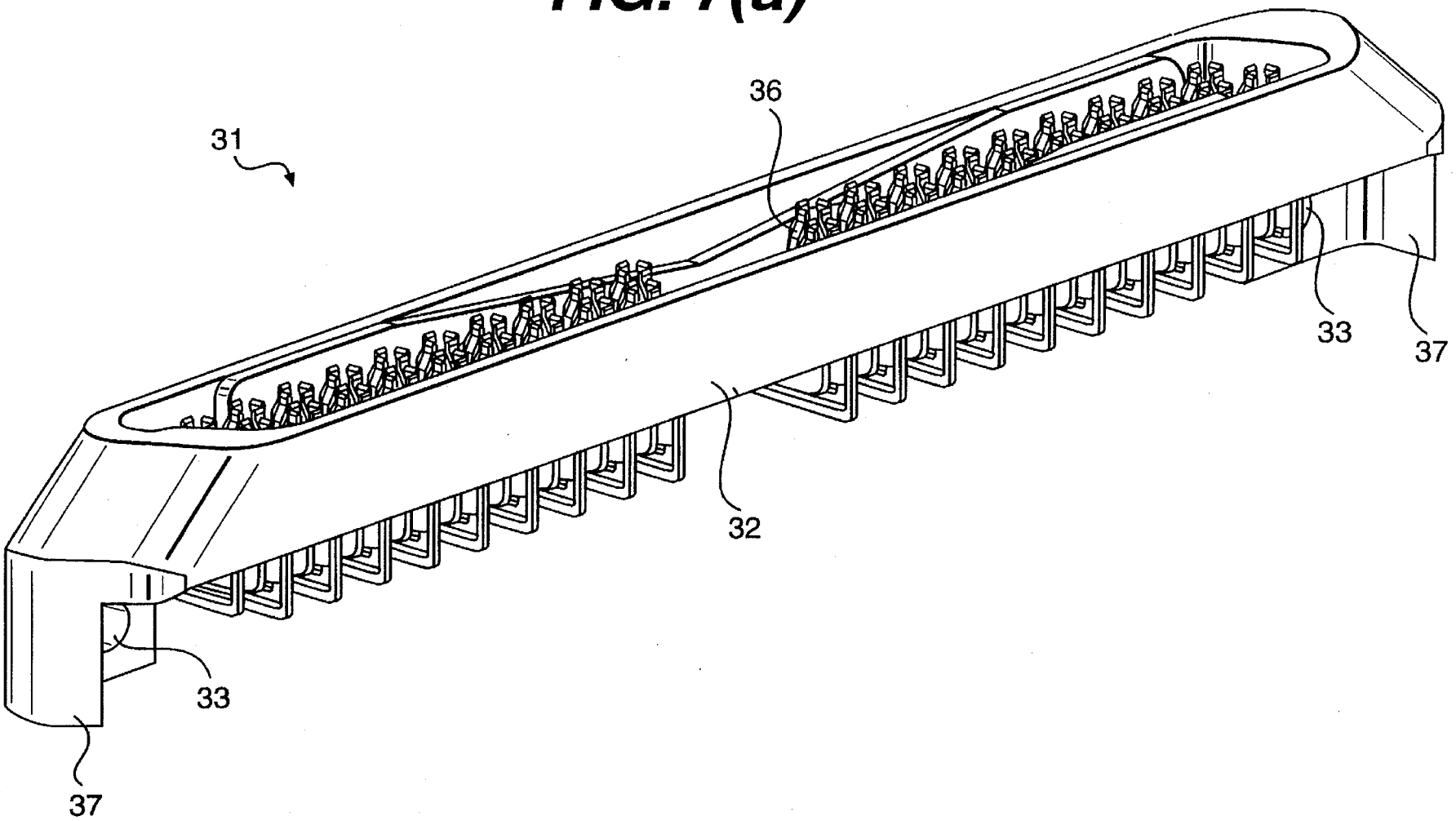
FIGS. 7(*a*), 7(*b*), 7(*c*), and 7(*d*) are different perspective views of a right-angle part that may be used as an electrical connector in accordance with the present invention.
Figure 7B:
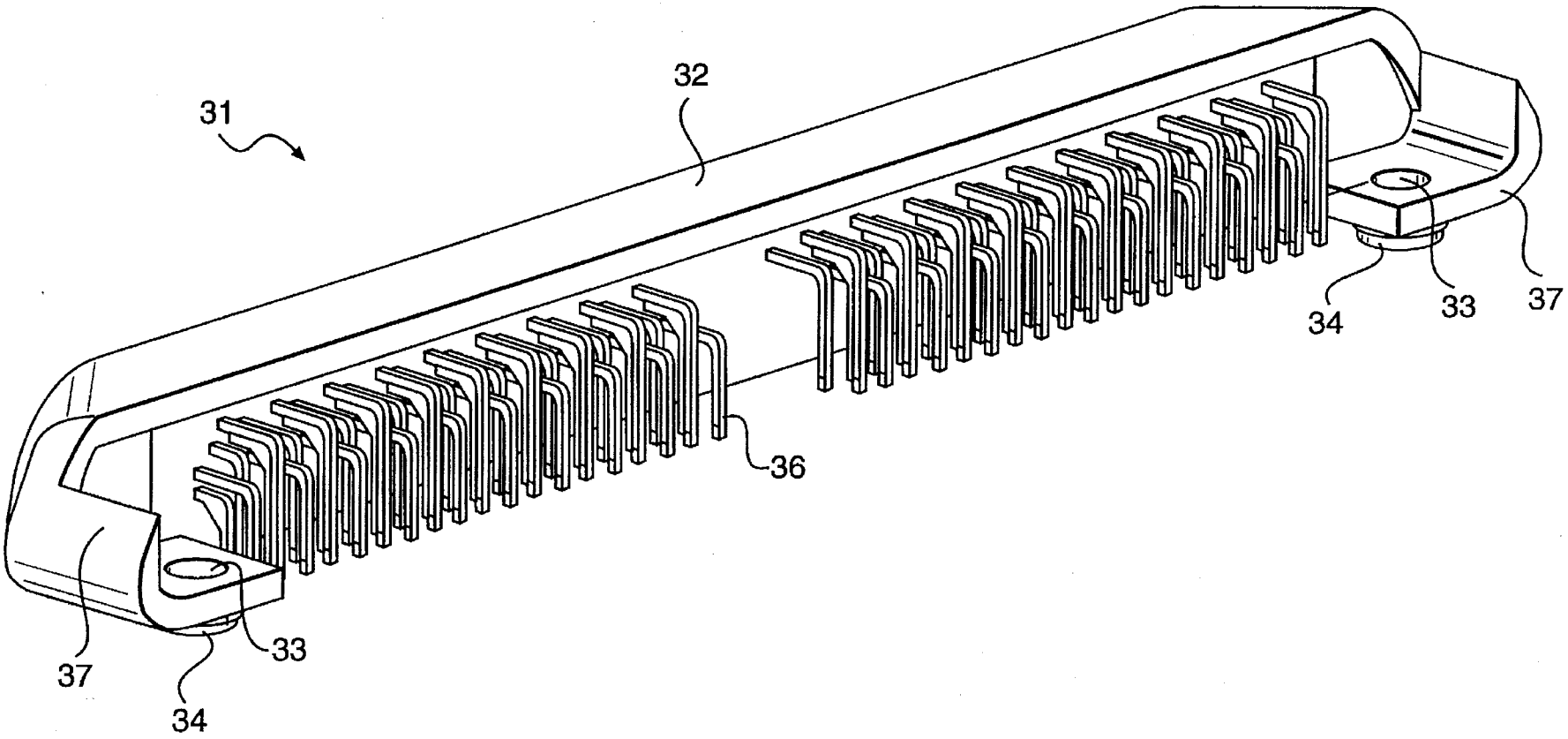
Figure 7C:
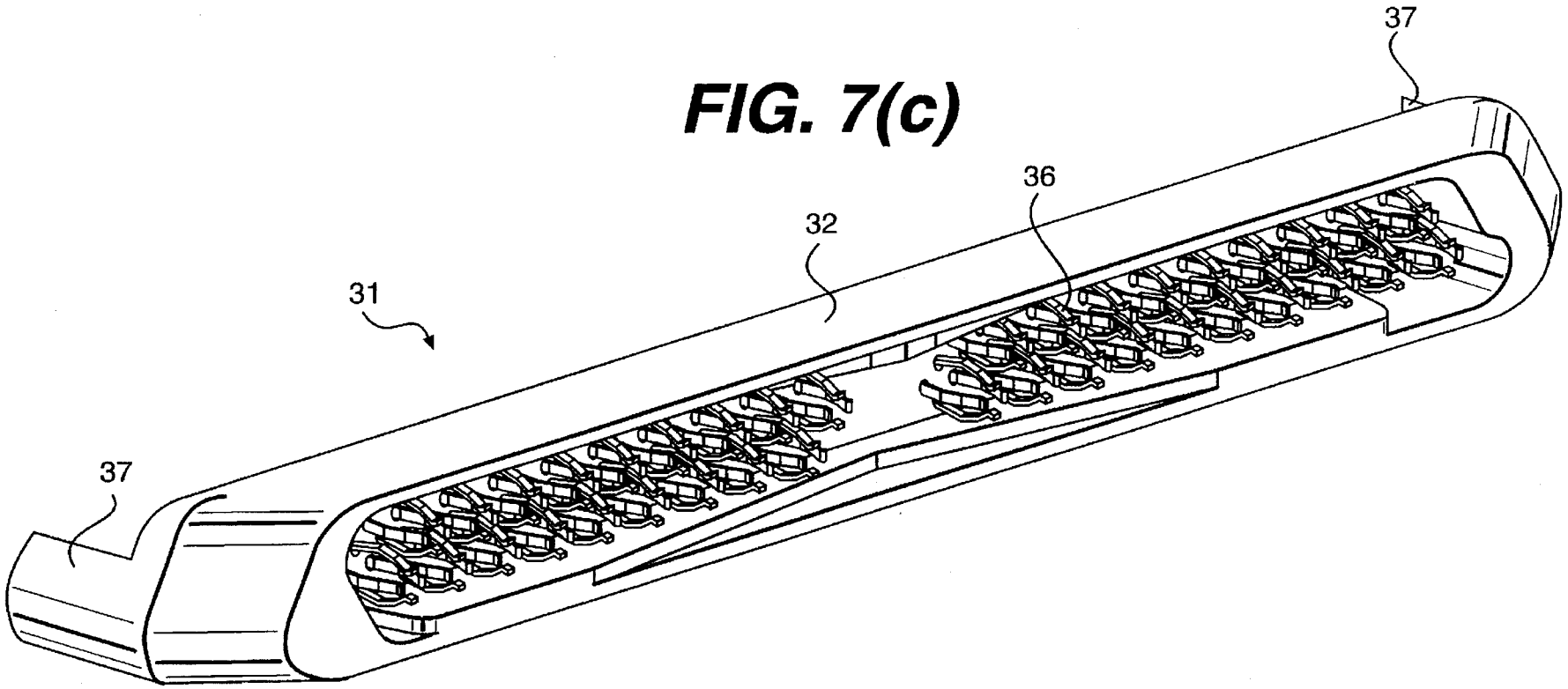
Figure 7D:
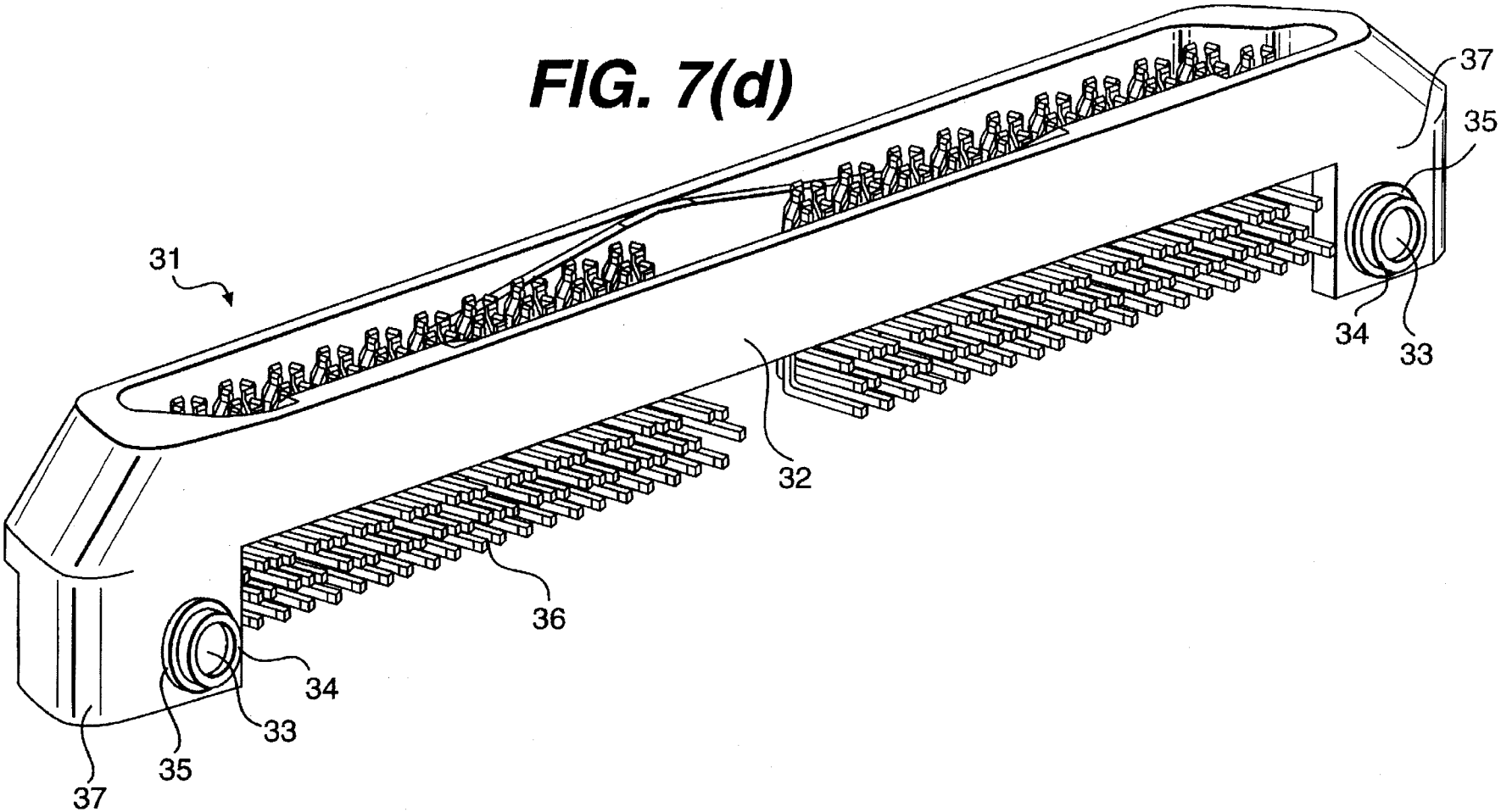

The alignment of first connector 21 and second connector 23 prior to mating can be understood from FIG. 2, discussed previously, and also from FIG. 5, which includes arrows designating complementary portions of first connector 21 and second connector 23. As can be understood from FIGS. 2 and 5, first connector 21 and second connector 23 are positioned so that end section 223 of first connector 21 is aligned with end section 243 of second connector 23, and so that protruding element 224*d* of end section 224 of first connector 21 is aligned with indented portion 244*a* of end section 244 of second connector 23, and then the connectors are urged together until mating commences as depicted in FIG. 6. Further urging causes contact between the upper edges of side wall 221 of first connector 21 and the upper edges of the contour of the inner periphery of side wall 241 of second connector 23, and contact between the upper edges of side wall 222 of first connector 21 and the upper edges of the contour of the inner periphery of side wall 242 of second connector 23, thereby completing the mating process.

The configuration of the end sections and the contoured side walls greatly facilitates the mating of first connector 21 with second connector 23. The end sections, for example, are polarized due to the provision of protruding element 224*d* on end section 224 and the provision of indented portion 244*a* on end section 244. Consequently, the end sections serve to prevent first and second connectors 21 and 23 from mating if the connectors are misoriented 180° relative to one another. If connectors 21 and 23 were allowed to mismate, the contact 25 carrying signal number one in first connector 21 would not connect to the contact 26 carrying signal number one in second connector 23, thereby resulting in an undesirable and intolerable condition for an electronics assembly.

The opposing contours formed in the inner part of the side walls of first and second connectors 21 and 23 serve to further align the connectors to one another during mating. Once the connectors have been oriented, because of the interference presented by the polarizing end sections, the side walls of connectors 21 and 23 further align and center the connectors relative to one another.

The contours on the side walls of first and second connectors 21 and 23 are compliments of one another. In addition to preventing the connectors from being forced together when they are 180° relative to one another, they also serve to guide and align the connectors as they slide together during mating. The distinctive contours on the shrouds and the end sections also prevent each connector from being mated with a different type or brand of connector, that is, one not designed with a complementary contour.

The previously-described embodiments of the present invention were discussed with reference to the use of electrical connectors incorporating vertical parts (also known as straight or in-line parts) as electrically conductive contacts. Vertical parts, as seen from FIG. 2, for example, are characterized by the straightness of the portions of the electrically conductive contacts extending out from below the floor surface in which such contacts are mounted (at 90° with respect to the printed circuit board in the preferred embodiment). The straightness of these contact portions allows each connector with vertical contacts to be mounted to a printed circuit board using a fastener provided through a fastener hole provided in the floor surface of the connector.

In addition to being applicable to connectors having vertical contacts, the present invention is also applicable for use with connectors having right-angle contacts. FIGS. 7(*a*), 7(*b*), 7(*c*), and 7(*d*), collectively referred to herein as FIG. 7, are different views of an exemplary connector 31 incorporating right-angle contacts 36 in accordance with the present invention. The present invention contemplates the situation where both connectors of an electrical interconnect system incorporate vertical contacts, the situation where both contacts of an electrical interconnect system incorporate right-angle contacts, and the situation where one of the connectors incorporates vertical contacts while the other connector incorporates right-angle contacts.

Shroud 32 of right-angle connector 31, as depicted in FIG. 7, is identical to shroud 24 of previously-described second connector 23. However, it should be noted that the shroud 32 of right-angle connector 31 could, alternatively, be configured in the same manner as shroud 22 of previously-described first connector 21. Both such variations are within the spirit and scope of the present invention.

The basic difference between a vertical connector (e.g., second connector 23 of FIG. 2) and a right-angle connector (e.g., right-angle connector 31 of FIG. 7) lies in the shape of the electrically conductive contacts. In the vertical connector, the portions of the contacts (contacts 26 of FIG. 2, for example) extending below the floor surface through which the contacts protrude are straight. In the right-angle connector, on the other hand, such portions of the contacts (contacts 36 of FIG. 7, for example) have a right-angle configuration in the manner depicted in FIG. 7.

Another difference lies in the contact support and hold-down structure. Rather than using a centrally-located fastener hole receiving a screw or other such fastener, each right-angle converter has hold-down sections 37 at both sides of the part with each hold-down section 37 containing a hole 33 with a sleeve 34. A central hold-down section could also be provided in addition to hold-down sections 37. The sleeves 34 fit into the corresponding holes on a printed circuit board (not shown). Preferably, sleeves 34 are only as long as half the printed circuit board is thick to allow for connectors to be mounted on both sides of the circuit board. A fastener (not shown), such as a screw, extends through each of holes 33 to secure connector 32 in place. Sleeves 34 each have a wider standoff area 35 around them that does not fit into the hole of the printed circuit board. Standoffs 35 serve to elevate connector 31 from the printed circuit board to allow for cleaning and uniform heating during the surface mounting process.

Whether a vertical connector or a right-angle connector is used effects the orientation of the opening at the top of each connector. If a vertical connector (e.g., second connector 23 of FIG. 2) is used, when mounted on a circuit board, the connector will be oriented with its shroud opening facing vertically away from the circuit board. If a right-angle connector (e.g., right-angle connector 31 of FIG. 7) is used, when mounted on a circuit board, the connector will be oriented with its shroud opening facing in a lateral direction parallel to the surface of the circuit board. Both implementations are useful and important manifestations of the present invention.

The preferred material for the insulating housing, including the shroud that surrounds the contacts and the contact support and hold-down structure, is a liquid crystal polymer such as VECTRA, which is a trademark of Hoescht Celanese, or some other type of plastic insulating material may be used. The housing is molded to form the elements described above. The contacts can be inserted into each connector housing, one by one or in a gang insertion process, or the insulator housing can be molded around such contacts.

It will be apparent to those skilled in the art that various modifications and variations can be made in the disclosed product without departing from the scope or spirit of the invention. For example, each disclosed fastener hole could be replaced with a guide post, integral fastener, or other hold-down section; each disclosed guide post could be replaced with a fastener hole, integral fastener, or other hold-down section; each disclosed integral fastener could be replaced by a fastener hole, guide post, or other hold-down section; and each disclosed hold-down section could be replaced by a fastener hole, guide post, or integral fastener. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An electrical interconnect system comprising:

a first electrical connector including a first plurality of electrically conductive contacts and a first insulative shroud shielding the first plurality of contacts, the first insulative shroud including a first side wall consisting of upwardly and downwardly sloping portions and a second side wall consisting of upwardly and downwardly sloping portions; and a second electrical connector including a second plurality of electrically conductive contacts and a second insulative shroud shielding said second plurality of contacts, said second insulative shroud including a third side wall having upwardly and downwardly sloping portions and a fourth side wall having upwardly and downwardly sloping portions, said first side wall being complementary with respect to the third side wall, the second side wall being complementary with respect to said fourth side wall, and said sloping portions being configured such that, upon mating of the first and second electrical connectors, upper surfaces of the sloping portions of said first side wall contact upper surfaces of said sloping portions of said third side wall, and upper surfaces of the sloping portions of said second side wall contact upper surfaces of the sloping portions of said fourth side wall, to facilitate mating alignment between said connectors.

2. An electrical interconnect system comprising:

a first electrical connector including a first plurality of electrically conductive contacts and a first insulative shroud shielding said first plurality of contacts, said first insulative shroud comprising a first side wall having upwardly and downwardly sloping portions and a second side wall having upwardly and downwardly sloping portions; and a second electrical connector including a second plurality of electrically conductive contacts and a second insulative shroud shielding said second plurality of contacts, said second insulative shroud comprising a third side wall having an outer peripheral portion and an inner peripheral portion, said inner peripheral portion including upwardly and downwardly sloping portions, and a fourth side wall having an outer peripheral portion and an inner peripheral portion, said inner peripheral portion including upwardly and downwardly sloping portions wherein said first side wall is complementary with respect to said third side wall, the second side wall is complementary with respect to said fourth side wall, and said sloping portions are configured such that, upon mating of the first and second electrical connectors upper surfaces of said sloping portions of the first side wall contact upper surfaces of said sloping portions of said third side wall, and upper surfaces of said sloping portions of said second side wall contact upper surfaces of the sloping portions of the fourth side wall, to facilitate mating alignment between said connectors.

3. The electrical interconnect system according to claim 2, wherein said first side wall consists of said upwardly and downwardly sloping portions, and the second side wall consists of the upwardly and downwardly sloping portions.

4. The electrical interconnect system according to claim 2, wherein said first insulative shroud comprises a plurality of end sections joining said first and second side walls, said second insulative shroud comprises a plurality of end sections joining said third and fourth side walls, and said end sections are polarized with respect to one another to prevent mismating of the first and second connectors.

5. The electrical interconnect system according to claim 4, wherein one of said end sections of said first insulative shroud comprises a protruding element, one of said end sections of said second insulative shroud comprises an indented portion, and said protruding element and the indented portion are configured such that the protruding element fits within said indented portion when said first and second connectors are mated.

6. The electrical interconnect system according to claim 3, wherein said upwardly and downwardly sloping portions of the first, second, third, and fourth side walls comprise polarization means for preventing mismating of said first and second connectors and for providing alignment between said contacts of said first and second connectors.

7. The electrical interconnect system according to claim 2, wherein at least one of said first plurality of electrically conductive contacts and said second plurality of electrically conductive contacts comprises a plurality of vertical contacts.

8. The electrical interconnect system according to claim 3, wherein at least one of said first plurality of electrically conductive contacts and said second plurality of electrically conductive contacts comprises a plurality of right-angle contacts.

9. The electrical interconnect system according to claim 3, wherein said first plurality of electrically conductive contacts comprises a plurality of vertical contacts and said second plurality of electrically conductive contacts comprises a plurality of right-angle contacts.

10. The electrical interconnect system of claim 3, wherein at least one of said connectors comprises at least one of a fastener hole, guide post, integral fastener, or hold-down section for mounting that connector to a substrate.

11. The electrical interconnect system of claim 10, wherein the substrate is a printed circuit board.

12. The electrical interconnect system of claim 5, wherein said protruding element is formed on an outer side surface of said one end section of the first insulative shroud and said indented portion is formed on an inner side surface of said one end section of the second insulative shroud.

13. An electrical interconnect system comprising:

a first insulative shroud for shielding a first plurality of contacts, first insulative shroud comprising first and second side walls, each having upwardly and downwardly sloping portions, and a plurality of first end sections joining first and second side walls, one of first end sections comprising a protruding element on an outer side surface therof; and a second insulative shroud for shielding a second plurality of contacts, said second insulative shroud comprising third and fourth side walls having upwardly and downwardly sloping portions and a plurality of second end sections joining third and fourth side walls, one of the second end sections having opposed inner and outer sides surfaces, said inner side surface comprising an indented portion thereon, and wherein the first side wall is complementary with third side wall, said second side wall is complementary with the fourth side wall, and, upon mating of the first and second insulative shrouds, upper surfaces of said sloping portions of said first side wall mate with upper surfaces of said sloping portions of said third side wall, upper surfaces of the sloping portions of the second side wall mate with upper surfaces of the sloping portions of said fourth side wall, and said protruding element is received within the indented portion, to facilitate mating alignment between said first and second insulative shrouds.

14. An electrical interconnect system comprising:

a first insulative shroud for shielding a first plurality of contacts, the first insulative shroud including opposing first and second side walls having upwardly and downwardly sloping portions, wherein the sloping portions of the first side wall slope toward each other, and the sloping portions of the second sidewall slope away from each other and a second insulative shroud surrounding a second plurality of contacts, the second insulative shroud including third and fourth opposing side walls having upwardly and downwardly sloping portions complementary to the opposing side walls of the first insulative shroud, respectively, wherein the upwardly and downwardly sloping portions of the third side wall slope away from each other, and the sloping portions of the fourth side wall slope toward each other, and wherein, upon mating of the first and second insulative shrouds, upper surfaces of the sloping portions of the first side wall mate with upper surfaces of the sloping portions of the third side wall, and upper surfaces of the sloping portions of the second side wall mate with upper surfaces of the sloping portions of the fourth side wall, to facilitate mating alignment between the first and second insulative shrouds.

15. The electrical interconnect system according to claim 14, wherein the third and fourth side walls each comprise an outer peripheral portion and an inner peripheral portion, and the upwardly and downwardly sloping portions of each of the third and fourth side walls are formed from the inner peripheral portion.

16. The electrical interconnect system according to claim 15, wherein the first and second side walls each consist of the upwardly and downwardly sloping portions.

17. The electrical interconnect system according to claim 15, wherein:

the first insulative shroud comprises a plurality of end sections joining said first and second side walls, a side of at least one of said end sections including a protruding element; and the second insulative shroud comprises a plurality of end sections joining the third and fourth walls, a side of at least one of said end sections comprising an indented portion, and said protruding element and said indented portion are configured such that the protruding element is received within the indented portion when said first and second insulative shrouds are mated.

18. The electrical interconnect system of claim 15, wherein at least one of said first and second insulative shrouds includes first and second guide posts for mounting that insulative shroud to a printed circuit board.

* * * * *

UNITED STATES PATENT AND TRADEMARK OFFICE

CERTIFICATE OF CORRECTION

PATENT NO. : 5,637,019

DATED : June 10, 1997

INVENTOR(S) : Crane, Jr. et al.

It is certified that error appears in the above-identified patent and that said Letters Patent is hereby corrected as shown below:

Column 10, line 1, change "the" to --said--;

line 13, change "the" to --said--;

line 17, change "the" to --said--;

line 20, change "the" to --said--;

line 21, change "the" to --said--;

line 44, change "the" to --said--;

line 47, insert a comma after "connectors";

line 48, change "the" to --said--;

line 52, change both occurences of "the" to --said--;

line 56, change "the" to --said--;

line 57, change "the" to --said--;

line 64, change "the" to --said--.

UNITED STATES PATENT AND TRADEMARK OFFICE

CERTIFICATE OF CORRECTION

PATENT NO. : 5,637,019
DATED : June 10, 1997
INVENTOR(S) : Crane, Jr. et al.

It is certified that error appears in the above-identified patent and that said Letters Patent is hereby corrected as shown below:

Column 11, line 2, change "the" to --said--;

line 3, change "the" to --said--;

line 8, change "the" to --said--;

line 12, change "2" to --3--;

line 35, change "the" to --said--;

line 37, change "the" to --said--;

line 40, add --said-- before "first";

line 43, both occurences, add --said-- before "first";

line 50, add --said-- before "third";

line 54, add --said-- before "third";

line 56, change both occurences of "the" to --said--;

UNITED STATES PATENT AND TRADEMARK OFFICE

CERTIFICATE OF CORRECTION

PATENT NO. : 5,637,019

DATED : June 10, 1997

INVENTOR(S) : Crane, Jr. et al

It is certified that error appears in the above-identified patent and that said Letters Patent is hereby corrected as shown below:

Column 12, line 1, change "the" to --said--;
line 2, change "the" to --said--.

Signed and Sealed this

Fifth Day of January, 1999

*Attest:*

*Attesting Officer*

*Acting Commissioner of Patents and Trademarks*